US012607028B2

(12) United States Patent
Bertrand et al.

(10) Patent No.: US 12,607,028 B2
(45) Date of Patent: Apr. 21, 2026

(54) SKIMMER APPARATUS

(71) Applicant: POOLFAST, Paris (FR)

(72) Inventors: Jacques Jean Bertrand, Rosay sur Lieure (FR); Gwenaelle Lucienne Marie Bertrand, Paris (FR)

(73) Assignee: POOLFAST, Paris (FR)

( * ) Notice: Subject to any disclaimer, the term of this patent is extended or adjusted under 35 U.S.C. 154(b) by 385 days.

(21) Appl. No.: 18/272,677

(22) PCT Filed: Feb. 2, 2022

(86) PCT No.: PCT/EP2022/052504
§ 371 (c)(1),
(2) Date: Jul. 17, 2023

(87) PCT Pub. No.: WO2022/167494
PCT Pub. Date: Aug. 11, 2022

(65) Prior Publication Data

US 2024/0084614 A1 Mar. 14, 2024

(30) Foreign Application Priority Data

Feb. 4, 2021 (EP) ..... 21155237

(51) Int. Cl.
*E04H 4/12* (2006.01)
*E02B 15/10* (2006.01)
*E04H 4/16* (2006.01)

(52) U.S. Cl.
CPC ..... *E04H 4/1263* (2013.01); *E04H 4/1609* (2013.01); *E02B 15/10* (2013.01)

(58) Field of Classification Search
CPC ..... E04H 4/1263; E04H 4/1609; E02B 15/01
USPC ..... 210/167.2, 170.09
See application file for complete search history.

(56) References Cited

U.S. PATENT DOCUMENTS

| | | | | |
|---|---|---|---|---|
| 5,043,060 | A | 8/1991 | Brennan | |
| 5,350,508 | A * | 9/1994 | Van der Watt | E04H 4/1263 210/167.2 |
| 5,614,085 | A | 3/1997 | Platt, III | |
| 2004/0182768 | A1 | 9/2004 | Blackman et al. | |
| 2008/0283457 | A1 | 11/2008 | Weiss | |
| 2009/0193776 | A1 | 8/2009 | Grosjean | |
| 2014/0158595 | A1* | 6/2014 | Stroeder | E04H 4/1263 210/167.19 |

OTHER PUBLICATIONS

Communication with regard to the EP Patent Application No. 22703379.2 dated Feb. 18, 2025.
International Search Report (and English Translation) and Written Opinion with regard to PCT/EP2022/052504 mailed Apr. 25, 2022.
European Search Report with regard to PCT/CN2022/077483 completed Jul. 14, 2021.

* cited by examiner

*Primary Examiner* — Fred Prince
(74) *Attorney, Agent, or Firm* — BCF LLP

(57) ABSTRACT

A skimmer apparatus comprising: a buoyant horizontal structure, a pocket-shaped net, a guide element longer than the buoyant horizontal structure and associated to the said buoyant horizontal structure, at least two ends of the buoyant horizontal structure are coupled to at least two parallel expanders, the ends of the at least two parallel expanders being attached to the pocket-shaped net (20).

15 Claims, 3 Drawing Sheets

[Fig. 1]
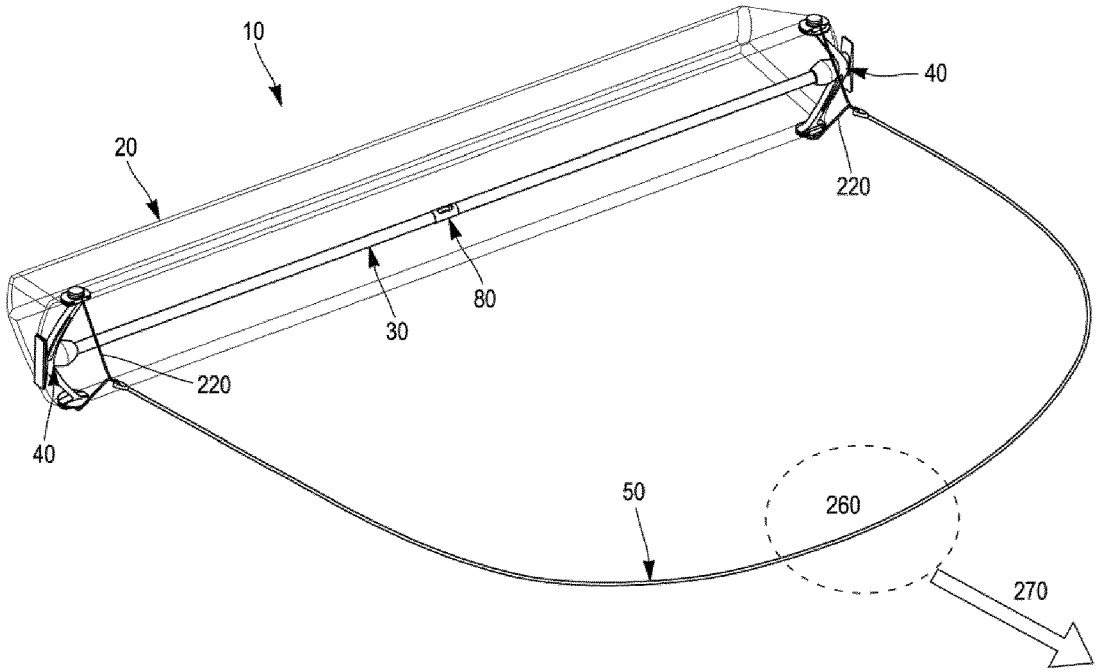
[Fig. 2]
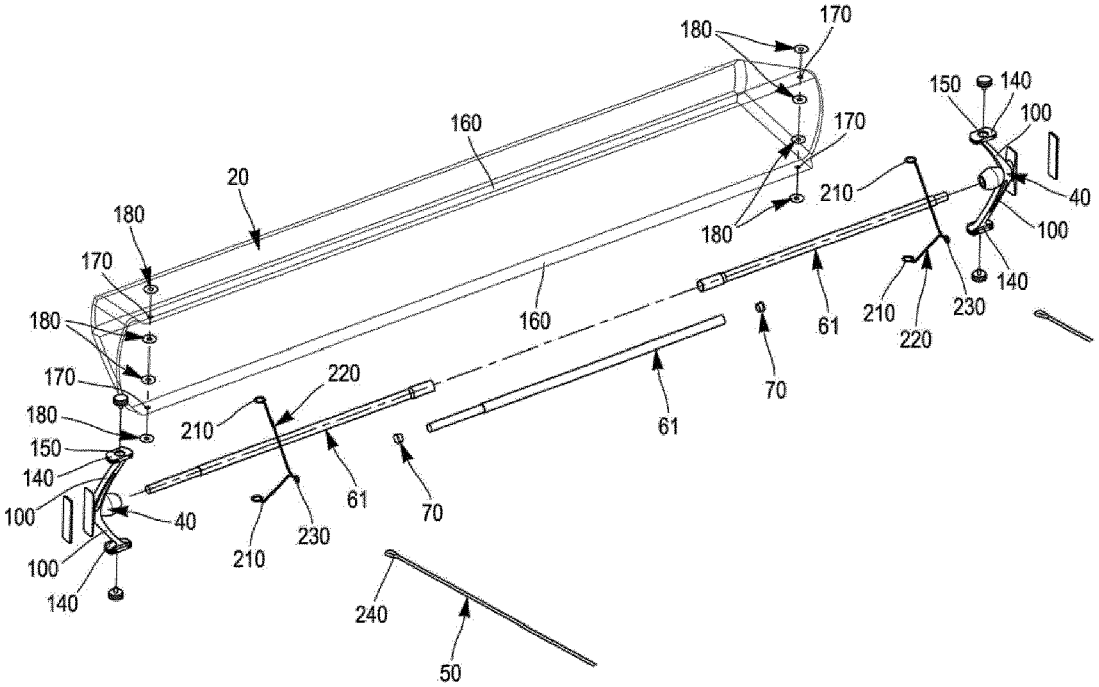

[Fig. 3]
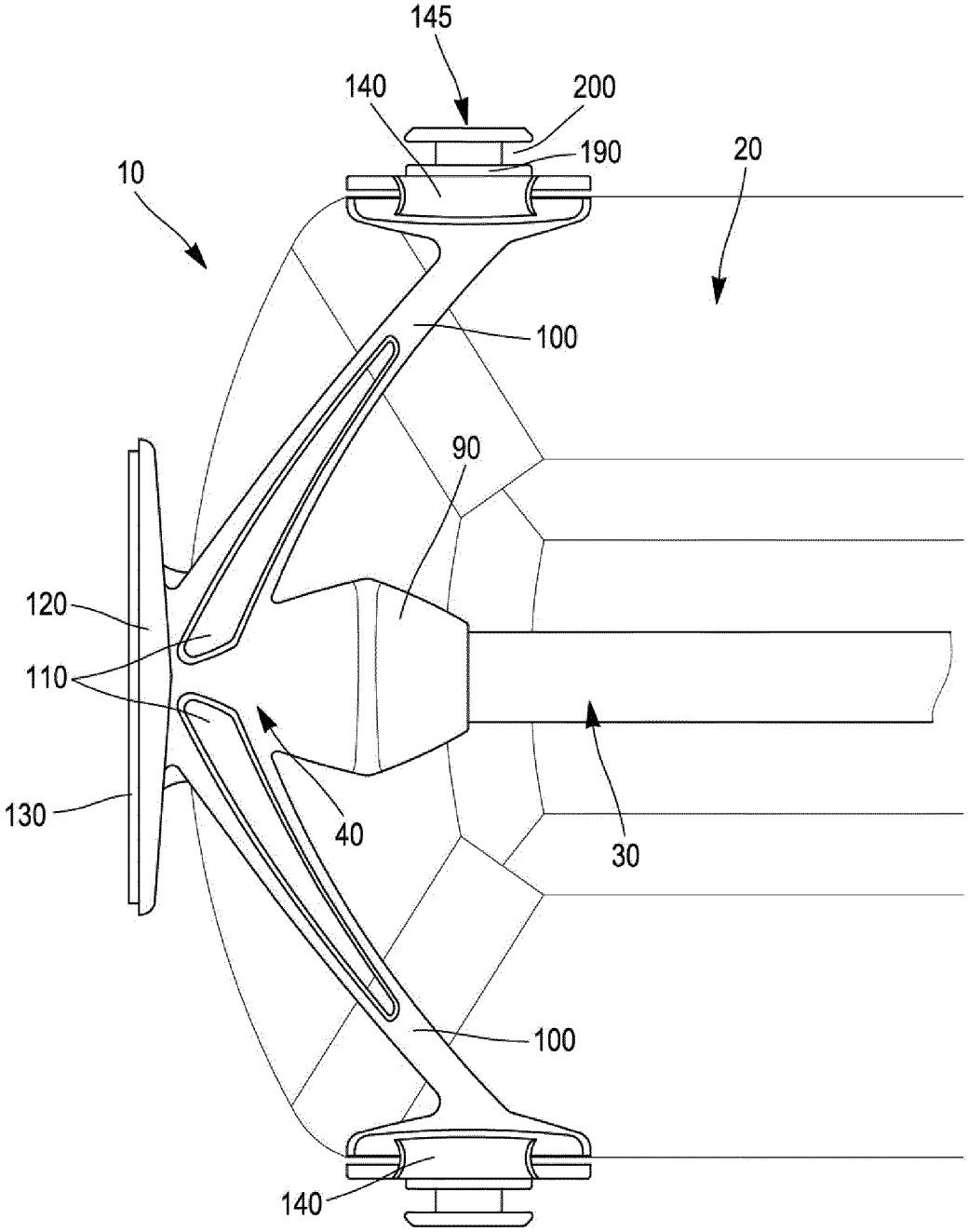

[Fig. 4]
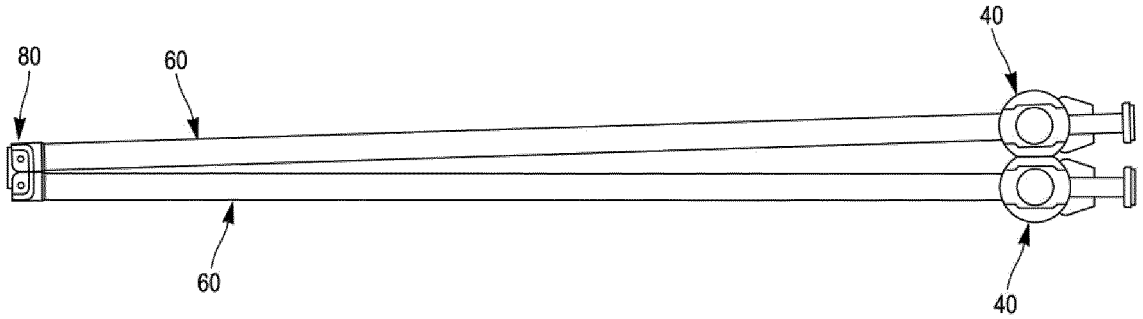

SKIMMER APPARATUS

FIELD OF THE INVENTION

The present invention relates to a device for removing floating debris from a surface of a body of water.

More specifically, the invention relates to a surface skimmer apparatus that is able to remove extraneous debris and other floating intruder objects from a surface or close to the surface of a body of water, for example a swimming pool.

TECHNOLOGICAL BACKGROUND

In the field of cleaning a body of water, the use of pool skimmer apparatus is known. The general configuration of pool skimmers disclosed in the prior art is a mesh netting attached to a rigid frame and having a rigid handle.

A user grasps and moves the skimmer apparatus through the water. Due to the material used, the user generally ensures that the skimmer does not become completely submerged below the water line in order to clean the waterline.

Furthermore, because of the rigid parts used, which provide additional weight, to have an efficient cleaning action, the prior art skimmers have to be continuously maintained by the user partially inside and partially outside the water and continuously moved forward. Due to the cantilevered pool skimmer apparatus held by the user at one end of a several-meter-long handle, a continuous effort must be provided by the user for an efficient cleaning effect.

In addition, the standard size available of the skimmers are generally undersized. Thus, the users have to repeat the cleaning operation several times to completely clean a water surface.

Users would benefit from a skimmer that does not require effort form the user to keep the skimmer apparatus partially inside and partially outside the body of water.

Documents US 2009/193776A1, US2004/0182768A1, U.S. Pat. Nos. 5,614,085A, 5,043,060 A describe a floating device for skimming the surface of a body of water.

Document U.S. Pat. No. 7,972,504 B2 is an example wherein a net material having a top edge is connected to a floatation element and extends nearly a complete width of the floatation element. A non-floatation element defines an operative bottom and is connected to a bottom edge of the net material. A guide element extends from a first side and a second side of the floatation element.

However, such a device is not efficient regarding the capture of debris on the surface. Indeed, water of the surface has to get around the floatation element, so a portion of the debris also gets around the floatation element with the water.

The invention thus aims at proposing an improved surface skimmer apparatus able to clean and keep all the debris floating near the surface without the effort of holding continuously a cantilevered pool skimmer apparatus.

Thus, one single pass is enough, no attention is required from the user to always have the best position of the skimmer apparatus, and the effort required is reduced.

SUMMARY OF THE INVENTION

Thus, the invention relates to a skimmer apparatus as described in claim 1.

By "parallel expanders" we mean that at least from two different angles of vision, the expanders are parallels once assembled. The four ends of the parallel expanders which are attached to the net (two ends per expander) are thus coplanar.

By "buoyant", we mean a horizontal structure able to stay on the surface of water, even with the net, the balance ropes and the flexible expanders attached the said horizontal structure.

By a "net", we mean a mesh structure fine enough to retain debris but to allow water to pass through. For example, debris of at least 1 millimetre are retained by the net.

By "pocket-shaped", we mean that the net is deployed around an entry area according to a 3D closed structure deployed from the entry.

Thanks to these provisions, the skimmer apparatus does not need a rigid structure surrounding the opening of the pocket-shaped net. One of the results is that the skimmer apparatus has a part of the pocket-shaped net inside the water and a part of the pocket-shaped net outside the water without any effort made by the user.

When the user starts to walk on the side of a swimming pool, the entry of the pocket-shaped net is facing the flux of the water, vertically, and is partially inside and partially outside the water without any effort of the user, except the traction force applied on the guide element. Thus, all the debris the size of which is larger than the size of the mesh size are collected inside the pocket-shaped net with one single pass and with minimum effort. The effort required is thus reduced to its minimum and cleaning the pool becomes as easy as a simple stroll around the swimming pool.

The absence of a reinforcement frame at the edge of the pocket-shaped net is also ensuring a better efficiency of the debris collection. It also simplifies the manufacturing process by reducing the manpower needed to assemble the skimmer apparatus. The risk of partial unhooking between the support structure and corresponding reparation of the skimmer apparatus also disappears.

According to different aspects, it is possible to provide the one and/or the other of the characteristics below taken alone or in combination.

According to one embodiment, the invention relates to a skimmer apparatus as described in claim 2.

By "balance element" we mean an element to couple two ends of the parallel expanders to the guide element.

Thus, the skimmer apparatus remains well-balanced when pulled in the water. By well-balanced, we mean that one portion of the skimmer apparatus remains in the water and one portion remains outside the water when the skimmer apparatus is pulled in the water.

According to one embodiment, the invention relates to a skimmer apparatus as described in claim 3.

By "flexible", we mean a material able to flex for instance by few centimetres at its end when the pocket-shaped net fixed at the ends applies a given pressure. For example, the pocket-shaped net has two holes spaced by a distance lower than the distance between two ends of one expander when no pressure is applied, at rest. The arms of the expander are flexed and the ends of the expander passed through the holes of the pocket-shaped net and the holes are filled completely.

By "coupling hole", we mean a hole the size of which is adapted to let pass through one end of the flexible parallel expander.

Thus, the horizontal edge of the pocket-shaped net is linear, avoiding any curvature of the horizontal edge of the pocket-shaped net. Curvatures of the horizontal edge of the pocket-shaped net reduce the efficiency of the cleaning action. In the case of a curvature of the upper edge of the pocket-shaped net is crossing the horizontal buoyant horizontal structure, the cleaning action is jeopardized.

According to one embodiment, the invention relates to a skimmer apparatus as described in claim 4.

Thus, the force applied on the pocket-shaped net by the parallel expander is diffused over a surface covered by the reinforcement piece instead of being concentrated on the contact point between the pocket-shaped net coupling hole edge and the parallel expander end. Thus, the risk of tearing of the pocket-shaped net is reduced.

According to one embodiment, the invention relates to a skimmer apparatus as described in claim 5.

According to one embodiment, the invention relates to a skimmer apparatus as described in claim 6.

According to one embodiment, the invention relates to a skimmer apparatus as described in claim 7.

Thus, the horizontal edge of the pocket-shaped net is reinforced.

According to one embodiment, the invention relates to a skimmer apparatus as described in claim 8.

Thus the skimmer apparatus is more stable when pulled in the water.

According to one embodiment, the invention relates to a skimmer apparatus as described in claim 9.

Thus, the parallel expanders can be easily manually fixed to and removed from the buoyant horizontal structure without any tool.

According to one embodiment, the invention relates to a skimmer apparatus as described in claim 10.

According to one embodiment, the invention relates to a skimmer apparatus as described in claim 11.

According to one embodiment, the invention relates to a skimmer apparatus as described in claim 12.

Thus, the drag in water of the skimmer apparatus is reduced.

According to one embodiment, the invention relates to a skimmer apparatus as described in claim 13.

Thus, the skimmer apparatus can lean on the edge of the swimming-pool, preventing scratching the swimming-pool wall.

According to one embodiment, the invention relates to a skimmer apparatus as described in claim 14.

Thus, strength and longevity of the skimmer apparatus are improved.

According to one embodiment, the invention relates to a skimmer apparatus as described in claim 15.

Thus, the space required to transport or to stock the skimmer apparatus is reduced. By storage configuration, we mean that the buoyant horizontal structure can ever be disassembled and reassembled, or that the buoyant horizontal structure comprises at least one hinge allowing the buoyant horizontal structure to be folded into 2 parts.

BRIEF DESCRIPTION OF THE DRAWINGS

Embodiments of the invention will be described below with reference to the drawings, described briefly below:

FIG. 1 represents a 3D view from an upper side of the skimmer apparatus.

FIG. 2 represents an exploded view of one embodiment of the skimmer apparatus from the same point of view as FIG. 1.

FIG. 3 represents a front view of one embodiment of one expander of a skimmer apparatus mounted.

FIG. 4 represents a side view of a folded skimmer apparatus without pocket-shaped net and guide element.

In the drawings, identical references designate identical or similar objects.

DETAILED DESCRIPTION

The invention relates to a skimmer apparatus 10, comprising a pocket-shaped net 20 fixed on a buoyant horizontal structure 30 through parallel expanders 40. The assembly is then attached to a guide element 50 dedicated to be handled by a user. The skimmer apparatus 10 will be described here in its configuration in use in a swimming-pool. The surface of the water in the swimming pool will define the horizontal plane. The pocket-shaped net 20 has an opening which surrounds an axis, which is an axis along which the skimmer apparatus is to be moved upon use.

Once assembled, in one embodiment, the buoyant horizontal structure 30 is a simple rigid rod of few centimetres of circular section for example. The length of the buoyant horizontal structure 30 is preferably between 1 meter and 3 meters, ideally 2 meters in order to cover the whole surface of a standard 4 meters by 8 meters swimming pool by only one single pass around all the edge of the swimming-pool.

The buoyant horizontal structure 30 can comprise a plurality of tubes 61 assembled to one another. The buoyant horizontal structure 30 is filled with foam cylinder or any other buoyant material and each opened end of the tubes 60 forming a rod is closed by a sealing plug 70. Thus, the floating ability of the buoyant horizontal structure 30 is secured; this embodiment reduces the risk of having the tubes 60 filled with water.

The buoyant horizontal structure 30 has several possible embodiments. One embodiment is represented in FIG. 1 and in FIG. 4. In the middle of the buoyant horizontal structure 30, a hinge 80 is attached to two tubes of same length. The length, the size and material of the tubes 60 are identical. Each tube 60 is filled with foam cylinder and each opened end of the tubes 60 is closed by a plug 70.

The flotation is ensured thanks to a choice of very light materials and thanks to integrated floats. The integrated floats do not generate resistance to displacement in the water and also do not interfere with the collection of debris.

The hinge 80 can flex by 180° in the direction opposite to the direction of normal movement of the skimmer apparatus 10 in use.

Thus, when in use, there is no risk for the skimmer apparatus 10 of being folded by the force of the water on the buoyant horizontal structure 30.

In addition, a blocking system at the hinge 80 could block the hinge opened or closed, reinforcing the stability of the buoyant horizontal structure 30.

In another embodiment, the buoyant horizontal structure 30 is made of 3 tubes 61 of length around 66 cm and their ends can fit to one another thanks to tube chambering of one end of each tube 61 in order to form, once assembled, one single 2 meters long rod buoyant horizontal structure 30. The number of tubes 61 can be increased or reduced. Each tube 61 is filled with foam cylinder and each opened end of the tubes 61 are closed by a sealing plug 70.

Once mounted, the buoyant horizontal structure 30 has at least two ends. In the embodiments presented, there are 2 ends for the buoyant horizontal structure 30. At these ends, parallel expanders 40 are fixed according to the same orientation. Below, we will detail one parallel expander 40 and its assembly to the buoyant horizontal structure. The same description may be applicable to another parallel expander, by symmetry with respect to a central vertical plane orthogonal to the buoyant horizontal structure. At the centre of the parallel expander 40, there is a fixing system 90 to couple the parallel expander 40 to the end of the buoyant horizontal structure 30.

In the introduced embodiments, the fixing system 90 comprises an elastic dovetail-shaped orifice in the parallel expander 40 adapted to the size of the end of the buoyant horizontal structure 30. Thus, the end of the buoyant horizontal structure 30 can be introduced manually without any tool into the elastic dovetail-shaped orifice of the parallel expander. The elastic force of the dovetail-shaped orifice blocks the parallel expander 40 in a position that can be adjusted manually but not by the force of the water when the skimmer apparatus 10 is pulled in the water. Alternatively, one may provide the dovetail shaped orifice on the buoyant horizontal structure 30 to receive the end of the parallel expander 40.

The structure of the parallel expander 40 is symmetrical with respect to a horizontal plane comprising the central axis of the elastic dovetail-shaped orifice. The parallel expander 40 comprises at least two arms 100. The size of these arms 100 can be for example between 20 and 40 centimetres long. The shape of each arm 100 is made to reduce its hydrodynamic footprint when the skimmer apparatus 10 is towed through water during normal use. Some holes 110 can be added through the arms 100 to reduce its hydrodynamic footprint.

On the side opposite to the fixing system 90 of the parallel expander 40, the parallel expander 40 comprises a vertical plate 120 oriented normal to the longitudinal axis of the buoyant structure and covered with an absorbent and/or abrasive sponge 130. Thus, the skimmer apparatus is naturally guided according to a direction parallel to the edge of the swimming-pool when it is pulled in the water. The skimmer apparatus 10 can also have a cleaning action on the vertical pool wall.

The ends of the arms 100 can comprise a simple rod or a more elaborated pocket-shaped net 20 coupling system. Below, we will describe the end of one arm 100, and the pocket-shaped net 20 coupling system. The same description may be applicable to the end of the other arm 100 of the parallel expander 40, by symmetry with respect to a horizontal plane. In the embodiment represented in the figures, the end of the arm comprises pliers 140 able to pinch a portion of the surface of the pocket-shaped net 20.

The plier comprises for example two opposite sides connected by a hinge. Once the plier 140 closed on the pocket-shaped net 20 with the pocket-shaped net 20 coupling hole 170 aligned with a plier hole 150, a closure system keeps both sides of the pliers 140 pressured on the pocket-shaped net 20. Each side can have a complementary hollow volume matching the volume of one eyelet 180 once the pocket-shaped net 20 coupling hole 170 is aligned with the plier hole 150.

These pliers 140 can either have a rod or a hole 150 in the middle. In the embodiment illustrated, it is a plier hole 150 in the middle of the pliers 140, at the end of the arm 100. In this embodiment, a fixing plug 145, whose diameter is suitable to pass through the pocket-shaped net coupling hole 170 (which will be described later) and the plier hole 150 at the end of the arm 100 is required in order to fix the pocket-shaped net 20 on the parallel expander 40.

The material used for the arm 100, PVC for instance, can be flexible enough to let the free ends of the arms 100 move from rest towards the centre of the buoyant horizontal structure 30. This pocket-shaped net 20 is fixed by only four points for example, at the end of the arms 100 of the flexible parallel expanders 40 that can be flexed when manually pressed. This flexing action is performed when the pocket-shaped net 20 is attached to the buoyant horizontal structure 30 through the parallel expanders 40.

The material choice for the skimmer apparatus is important to prevent the system from leaking, rusting, breaking.

The pocket-shaped net 10 is made of an assembled piece of fabric whose mesh is large enough to allow water to pass through but not debris.

The edge of the opening of the pocket formed by the pocket-shaped net 10 is ideally reinforced by a pocket-shaped net outlet, or lining edge 160.

The shape of the pocket-shaped net 20 is like a recipient or a pocket with a rectangular opening orifice. Further, the pocket-shaped net 20 comprises coupling holes 170 on its front portion, for assembly to the parallel expanders 40.

The horizontal distance between two coupling holes 170 should not be longer than the horizontal distance of the two ends of the arms 100 of the parallel expanders 40. Ideally, the horizontal distance between two coupling holes 170 is slightly shorter than the horizontal distance of the two ends of the arms 100 of the parallel expanders 40. By slightly shorter, we mean 1 to 2% of the length for instance, which is 2 to 4 centimetres for a 2 metres long distance between 2 ends of 2 arms 100 of 2 different parallel expanders 40. In the case of the horizontal distance is 2 meters between the ends of 2 arms 100 of 2 different parallel expanders 40, the length between the coupling holes 170 of one side of the pocket-shaped net 20 can be about 1m96.

To fix the pocket-shaped net 20 on the parallel expanders 40, it can be necessary to first manually flex the arms 100 of one parallel expander 40 in the direction toward the other parallel expander 40. Thus, the distance between the holes 150 of the end of the arms 100 can be reduced by few centimetres.

The flex of the arms 100 changes the orientation of the pliers 140. The pliers 140 can be ideally inclined to the opposite direction of the flex of the arms 100 when the pocket-shaped net 20 is fixed on the end of the said arms 100. Thus, once the arms 100 are flexed by the pocket-shaped net 20 fixed, the pliers 140 are in the ideal horizontal position. Thus, the pliers reinforce the horizontal position of the edge of the pocket-shaped net 20.

A fixing hole 170 of the pocket-shaped net 20 can have an eyelet 180 to reinforce the pocket-shaped net 20, to avoid dislocation of the pocket-shaped net 20 at the level of the coupling holes 170 of the pocket-shaped net 20.

The fixing plug 145 to be coupled at the end of the arm 100 of the parallel expander 40 comprises a cylindrical head 190 whose diameter is bigger than the holes 150 of the pliers 140 and the coupling holes 170 of the pocket-shaped net 20. The cylindrical head 190 is connected to a portion of torus the size of which is adapted to go through coupling holes (150, 170) of the pocket-shaped net 20 and of the pliers 140. The fixing plug 145 is fixed to the arms 100 of the parallel expanders 40 by any conventional means (screwing, clipping, etc.). The head 190 comprises a groove 200 adapted to couple a balance rope loop 210.

Balance elements 220 comprise a rope made of flexible or semi-flexible material, with three loops, one balance element loop 210 at each end of each balance element 220, and one central loop 230 in the middle of each balance element 220. The length of the balance element loops 210 at the ends of the balance elements 220 are slightly longer than the length of the groove 200 of the head of the fixing plugs in order to be free to move in the groove 200. The length of the balance element loops 210 are tight enough for not being removed from the groove 200.

The ends of one balance elements 220 can be fixed respectively to the end of each arm 100 of one parallel expander 40 and the balance loop can comprise an equidistant loop. By "equidistant", we mean at a similar distance from each end of the balance elements 220. Nevertheless, this distance can be slightly different. As a result, the parallel expander 40 will be slightly oblique when the skimmer apparatus is pulled in the water. This difference should not be over 5%, otherwise the skimmer apparatus will lose cleaning action efficiency.

Thus, the axis passing through the central loops 230 of the balance elements 220 is horizontal when the skimmer apparatus is in the water. In this embodiment, these two central loops are crimped by a non-corrosive crimp. These central loops 230 are chained with the end loops 240 of the guide element 250. The guide element 250 is made of a -flexible rope. The length of the guide element 250 is for example 4 meters. The part of the guide element to be handled is the area identified by the dashed oval 260. The direction of use is symbolized by the arrow 270.

A normal user, standing on the side of a swimming-pool, can walk parallel to the edge of a standard swimming-pool of 4 meters by 8 meters at normal speed, with natural position of arms when walking, pulling with fingertips the skimmer apparatus 10 in the water. If the pool has angles, especially right angles, the skimmer apparatus 10 can easily be manipulated to clean the surface of the water around that angle. When the user is back to the starting point, the whole surface of the swimming-pool has been cleaned by the skimmer apparatus 10. By removing from the water the skimmer apparatus 10 with the pocket-shaped net 20 filled with debris, the cleaning operation is over.

The skimmer apparatus 10 can be unmounted when not used, for instance for stockage during winter, or for transportation, and mounted before use.

The steps of mounting are:

deploying or assembling the buoyant horizontal structure 30;

fixing the parallel expanders 40 at the ends of the buoyant horizontal structure 30;

fixing the pocket-shaped net 20 at the ends of the arms 100 of the parallel expanders 40;

fixing one balance element 220 comprising the guide element 50 at each parallel expander 40.

The above sequence with fixing actions replaced by unfixing actions and assembling by disassembling is the unmounting process of the skimmer apparatus 10.

One of the options for the assembly of the tubes 61 is a telescopic bar. The telescopic bar is made up of tubes 61 that fit together and slide into each other.

The telescopic bar can be deployed or retracted. When retracted, the telescopic bar is of a smaller size; it is easier to store the skimmer apparatus.

When the tubes 61 are deployed, they lock to remain deployed, which allows optimal tension of the pocket-shaped net 20. Tubes 61 are of suitable diameters so that each tube 61 can slide inside the next one, the outside of an internal tube 61 remaining in contact with the inside of the next outer tube 61. The tubes 61 include means for stopping the sliding before two consecutive tubes 61 no longer have enough contact to guarantee the rigidity of the telescopic bar. The said means are also able to reversibly lock the tubes 61 in this position.

While exemplary embodiment of the invention has been described with reference to two main embodiments, it will be understood by those skilled in the art that various changes, omissions and/or additions may be made, and equivalents may be substituted for elements thereof without departing from the spirit and scope of the invention. In addition, many modifications may be made to adapt a particular situation or material to the teachings of the invention without departing from the scope thereof. Therefore, it is intended that the invention is not limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

LIST OF NOMENCLATURE

10: skimmer apparatus
20: pocket-shaped net
30: buoyant horizontal structure
40: parallel expanders
50: guide element
60, 61: tubes
70: sealing plug
80: hinge
90: fixing system
100: arm
110: holes (through the parallel expanders)
120: vertical plate
130: sponge
140: pliers
145: fixing plugs
150: plier hole
160: lining edge
170: coupling holes
180: eyelets
190: cylindric head
200: groove
210: rope loop
220: balance elements
230: central loops
240: end loops
260: dashed oval
270: arrow

The invention claimed is:

1. A skimmer apparatus comprising: a buoyant horizontal structure, a pocket-shaped net, a guide element longer than the buoyant horizontal structure and associated to the said buoyant horizontal structure, wherein at least two ends of the buoyant horizontal structure are coupled to at least two parallel expanders, wherein the ends of the at least two parallel expanders are attached to the pocket-shaped net, and wherein at least two balance elements are attached respectively to the at least two parallel expanders and coupled to the guide element.

2. The skimmer apparatus of claim 1, wherein:

the pocket-shaped net comprises coupling holes, the parallel expanders are flexible, and the distance between two coupling holes to be coupled on the ends of two different flexible parallel expanders is shorter than the distance between the said two different flexible parallel expanders ends when parallel expanders ends are uncoupled.

3. The skimmer apparatus of claim 2, wherein at least one coupling hole is surrounded by at least one reinforcement piece pinching a portion of the pocket-shaped net around the coupling hole.

4. The skimmer apparatus of claim 3, wherein the pocket-shaped net comprises at least one eyelet that surrounds the at least one coupling hole.

5. The skimmer apparatus of claim 3, wherein the at least one reinforcement piece comprises a plier part of the ends of the parallel expanders.

6. The skimmer apparatus of claim 5, wherein the plier parts are horizontal when the parallel expanders are flexed by the pocket-shaped net.

7. The skimmer apparatus of claim 1, wherein one parallel expander is symmetrical with respect to a horizontal plane.

8. The skimmer apparatus of claim 1, wherein the parallel expanders comprise an elastic orifice coupled to the ends of the buoyant horizontal structure.

9. The skimmer apparatus of claim 1 wherein the parallel expanders comprise two symmetric inclined arms, inclined with respect to the axis of the buoyant horizontal structure, and wherein the inclination of the arms is stretching horizontally the pocket-shaped net.

10. The skimmer apparatus of claim 1, wherein the ends of the parallel expanders comprise pliers to ensure the attachment of the parallel expanders to the pocket-shaped net.

11. The skimmer apparatus of claim 1, wherein the ends of the parallel expanders have a groove to couple the balance elements.

12. The skimmer apparatus of claim 1, wherein the parallel expander has holes oriented in a direction of a water flux when the skimmer apparatus is used.

13. The skimmer apparatus of claim 1, wherein at least one parallel expander has a vertical plate on the side of the parallel expander opposite to the parallel expander side coupled to the buoyant horizontal structure and perpendicular to the said buoyant horizontal structure.

14. The skimmer apparatus of claim 1, wherein the pocket-shaped net comprises a lining edge.

15. The skimmer apparatus of claim 1, wherein the buoyant horizontal structure has a storage configuration comprising at least two tubes whose ends are either configured to thread one into the other up to a limit or are linked one to another by at least one hinge whose maximum opening is 180°.

* * * * *